US006513891B2

(12) United States Patent
Eida

(10) Patent No.: US 6,513,891 B2
(45) Date of Patent: Feb. 4, 2003

(54) PRINT LIQUID TANK AND PRINTING APPARATUS HAVING THE SAME

(75) Inventor: Masataka Eida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,326

(22) Filed: Apr. 17, 2001

(65) Prior Publication Data

US 2001/0033316 A1 Oct. 25, 2001

(30) Foreign Application Priority Data

Apr. 18, 2000 (JP) ..... 2000-117064

(51) Int. Cl.[7] ..... B41J 2/195; B41J 29/393; B41J 29/38

(52) U.S. Cl. ..... 347/7; 347/19; 347/14

(58) Field of Search ..... 347/7, 19, 14, 347/23, 85, 86

(56) References Cited

U.S. PATENT DOCUMENTS

| | | | | |
|---|---|---|---|---|
| 4,415,886 A | | 11/1983 | Kyogoku et al. | 340/618 |
| 4,516,135 A | * | 5/1985 | Todoh | 347/7 |
| 4,910,604 A | * | 3/1990 | Takei et al. | 358/310 |
| 5,729,256 A | * | 3/1998 | Yamanaka et al. | 347/7 |
| 5,992,986 A | * | 11/1999 | Gyotoku et al. | 347/85 |

FOREIGN PATENT DOCUMENTS

| | | |
|---|---|---|
| JP | 47-45638 | 12/1972 |
| JP | 51-21443 | 2/1976 |
| JP | 55-158977 | 12/1980 |
| JP | 57-34966 | 2/1982 |
| JP | 57-34967 | 2/1982 |
| JP | 57-34990 | 2/1982 |
| JP | 58-211482 | 12/1983 |
| JP | 59-194855 | 11/1984 |
| JP | 59-204565 | 11/1984 |
| JP | 5-169679 | 7/1993 |

* cited by examiner

*Primary Examiner*—Raquel Yvette Gordon
*Assistant Examiner*—Charles W. Stewart, Jr.
(74) *Attorney, Agent, or Firm*—Fitzpatrick, Cella, Harper & Scinto

(57) ABSTRACT

An ink consumption detection unit 60 includes the contact tape 84, whose one end is secured to the tank case 62 side and the other end to the flexible ink bag 68 side, and the contact electrode member 88 secured to the ink bag 68 side and placed in contact with the contact tape 84. As the ink in the ink bag 68 is consumed, the contact electrode member 88 is moved. When the contact electrode member 88 comes into contact with a plurality of contact electrodes 84EA, 84EB, 84EC representing ink consumptions in stages, the ink consumption detection unit 60 successively issues detection signals representing the ink consumptions.

16 Claims, 14 Drawing Sheets

| DISPLAY | SIGNAL LEVEL | SIGNAL LEVEL | A COLOR OF A LED | THE AMOUNT OF INK CONSUMED |
|---|---|---|---|---|
| SAFETY LEVEL | 88A:H<br>88B:L<br>88C:L | L1:H<br>L2:L<br>L3:L<br>L4:L<br>L5:L | BLUE | 0~30 |
| CAUTION LEVEL | 88A:H<br>88B:H<br>88C:L | L1:H<br>L2:H<br>L3:H<br>L4:L<br>L5:L | BLUE-GREEN | 30~35 |
| MORE CAUTION LEVEL | 88A:L<br>88B:H<br>88C:L | L1:L<br>L2:L<br>L3:H<br>L4:L<br>L5:L | YELLOW-GREEN | 35~37 |
| INK TANK CHANGE PREPARATION LEVEL | 88A:L<br>88B:H<br>88C:H | L1:L<br>L2:L<br>L3:H<br>L4:H<br>L5:H | ORANGE | 37~38 |
| WARNING LEVEL (INK TANK CHANGE INSTRUCTION LEVEL) | 88A:L<br>88B:L<br>88C:H | L1:L<br>L2:L<br>L3:L<br>L4:L<br>L5:H | RED | 39~39.5 |
| PRINTING STOPPING INSTRUCTION (BEEP TONES OCCURRENCE) | 88A:L<br>88B:L<br>88C:L | L1:L<br>L2:L<br>L3:L<br>L4:L<br>L5:L | SHUTOFF | 40 |

FIG.10

PRINT LIQUID TANK AND PRINTING APPARATUS HAVING THE SAME

This application is based on Patent Application No. 2000-117064 filed Apr. 18, 2000 in Japan, the content of which is incorporated hereinto by reference.

BACKGROUND OF THE INVENTION

1. Field of the Invention

The present invention relates to a print liquid tank for supplying a print liquid to a print head that prints on a printing medium, and to a printing apparatus having the print liquid tank.

2. Description of the Related Art

A continuous type large industrial printing apparatus was once a mainstream ink jet printer. An ink jet printer as a printing apparatus using an on-demand type ink jet print head came into wide use. As for an ink storage system in the ink jet print head, when a faster printing speed of the ink jet print head began to increase the ink consumption in recent years, the merits of the ink storage bag that can provide a large capacity of ink storage relatively easily ,received attention. This is because, as there are growing demands for more varied kinds of prints, from conventional monochromatic prints to color prints of symbols and characters to high vivid prints such as photographic images, the number of inks used and the amount of each ink consumed have increased dramatically. For example, a conventional monochromatic print of A4 size uses 30–60 mg of ink per sheet at most whereas a full color image print requires about 500–2000 mg/sheet.

There are many proposals concerning the ink storage system using the bag in an ink storage system, and many proposals concerning system for detecting an amount of ink remaining in the ink storage bag are open to the public.

The system for measuring the amount of ink remaining in the ink storage bag has a mechanism that visually indicates the remaining amount of ink, as disclosed for example in Japanese Patent Application Laid-open Nos. 158977/1980 and 211482/1983.

While many technologies have been proposed publicly which concern the ink storage bag and system which measure the amount of ink remaining in the ink storage bag, but, they are mostly not put to practical use or, if adopted, only for a short period of time.

Among the reasons for this are a problem of a precision at which the remaining amount of ink is detected, a problem of increased steps in the assembly process, a problem that the remaining amount of ink can only be indicated but cannot be fed back to the printer body, and a problem of requiring a generous cost increase for implementing the feedback.

Examples of the conventional systems are detailed below. In Japanese Patent Application Laid-open Nos. 45638/1972 and 21443/1976, for example, the amount of remaining ink is detected based on a change in the amount of light passing through the ink. This method detects not the actual amount of the remaining ink but only the presence or absence of the ink. That is, it has a drawback of being unable to detect a change in the ink consumption and also a drawback of requiring a mechanism for generating light and a device for detecting the amount of light transmitted and converting the detected light output into a digital value or electric signal.

Proposed methods other than the one based on the change in the amount of light that has passed through the ink include one in which an ink level displacement resulting from the consumption of ink in the ink storage bag arranged inside a case is converted by a strain-resistance gauge into a change in electric resistance (Japanese Patent Application Laid-open No. 34966/1982); one which converts the ink level displacement into a change in electrostatic capacitance (Japanese Patent Application Laid-open No. 34990/1982); one having a mechanism that visually displays the ink level displacement as above(Japanese Patent Application Laid-open No. 158977/1980, 211482/1983); and one that converts the ink level displacement into a change in the amount of reflected light or magnetism (Japanese Patent Application Laid-open No. 194855/1984, 169679/1993).

In these non-contact detection systems (based on electrostatic capacitance for example), variations in the deformations of the individual ink storage bags that may degrade the detection precision must be considered. Particularly in the systems that detect changes in the electrostatic capacitance and magnetism, these changes are inversely with the square of the distance , which is disadvantageous to the detection of the remaining mount of ink. This is because an initial change is large and a change at the last stage extremely small, making it difficult to detect a final point in the amount of remaining ink (minimum amount of remaining ink), the most critical information.

In the case of a light reflection type ink consumption detection unit, as shown in Japanese Patent Application Laid-open No. 169679/1993 and in FIGS. 14A and 14B, an ink consumption detection unit 6 is rigidly held inside a case 2 so that it faces an ink storage bag 4 (hereinafter referred to also as an ink bag) accommodated in the case 2.

The ink bag 4 is provided at one of its ends with a joint portion 8 which has a needle 10 communicating the interior of the ink bag 4 with the interior of the print head to supply the ink IN contained in the bag to the print head.

The ink consumption detection unit 6 comprises a light emitting element portion 6A, which has a light emitting diode LED or infrared LED to emit a light beam toward the surface of the ink bag 4 made from an aluminum foil composite film, and a light receiving element portion 6B that detects the light beam reflected from the surface of the ink bag 4. A signal output from the light receiving element portion 6B of the ink consumption detection unit 6 and representing an amount of reflected light corresponding to the reflectivity is an analog signal and thus requires an A/D converter to produce a signal that indicates the remaining amount of ink.

Although the ink consumption detection unit 6 is shown to be small relative to the ink bag 4 in FIGS. 14A and 14B, the size of the unit 6 is difficult to reduce. The ink consumption detection unit 6 measures e.g. about 30 mm high by 15 mm wide by 40 mm long. One of the reasons that the unit 6 has such a large size is that the ink bag 4 has a thickness or height of at least 5 mm in connection with a minimum required amount of stored ink (at least 20 ml or more) and that the unit 6 is required to have a sufficient depth of focus to cover the change in the bag height. Among other reasons result from design conditions that consider the formation of a light path between the light emitting element portion 6A and the light receiving element portion 6B, the mounting of these elements to the substrates and to the case 2 and the securing of wiring portions of the substrates. Further, the arrangement of the ink consumption detection unit 6 at the side of the ink bag 4 increases an idle space within the case 2, deteriorating the accommodation efficiency of the case 2.

When the ink bag 4 changes its state from FIG. 14A in which it is filled with a predetermined amount of ink IN to FIG. 14B in which the ink IN is consumed, the ink consumption detection unit 6 outputs a signal representing the amount of reflected light in response to a change in degree of light reflectance.

At the time, the ink bag 4 is formed of a reflective aluminum foil composite film and, because of the presence of the joint portion 8, has a sufficient rigidity not to collapse completely when the ink IN is consumed. Hence, there are some variations in the thickness of the bag. In such cases, variations in the reflection direction of the light beam in the ink consumption detection unit 6 and variations in the amount of reflected light detected by the light receiving element portion 6B may combine to make the precise detection impossible. To prevent this, a spring member that urges the ink bag 4 in the contract direction needs to be installed in the case 2. If such a spring member is provided, the ink residual amount detection of this system cannot be realized with good reproducibility without using a joint portion that can withstand the inner pressure produced by the urging force of the spring member.

In the system described above that detects a change in the reflected light amount, there is an advantage that the range of signal level change can be increased by making the signal level corresponding to the final point or its vicinity in the amount of remaining ink (near the minimum amount of remaining ink) maximum. On the other hand, however, the system requires a lens and other system of optical path to increase the focal depth corresponding to nearly the minimum amount of remaining ink. When such systems are not provided, shifts or variations in the position and angle of the surface of the ink storage bag cannot be corrected, making it impossible to reliably measure the change in the amount of remaining ink, though it may be possible to detect the presence or absence of ink.

Further, in the above detection method that converts the displacement or deformation of the ink bag resulting from ink consumption into a change in electric resistance, electrostatic capacitance, reflected light amount or magnetism, a device or circuit is required for transforming the signal obtained into a concrete electric signal. When, for example, seven color ink storage bags are mounted in the ink jet printer, seven devices or circuits need to be provided.

Here, the critical difference between the presence/absence of ink in the ink bag 4 and the amount of ink consumption (remaining amount) will be detailed. The presence/absence of ink simply means the detection of whether or not the ink exists. On the other hand the amount of ink consumption (amount of remaining ink) is taking numerical form of how much of the ink has been used or how much ink remains.

Because the ink consumption in the printer has increased as above, this difference is important. Specifically speaking, occasions often occur when a text containing photographic images (such as a catalog containing photographs) is printed by an ink jet printer for a total of, say, 100 copies. Or individual images may be printed for a total of about 20 copies to produce documents (e.g., a report in a booklet form containing photographs). If 0.1 g of cyan ink is used for one printed sheet, 100 sheets consume 10 g of cyan ink. When only 5 g of ink remains in the ink tank, the print task under consideration cannot be completed. Or in the middle of the printing process the printer outputs a printed image with no cyan ink on it. This problem can occur with the method that detects only the presence/absence of ink.

When a device capable of detecting the amount of ink used (amount of remaining ink) with a certain extent precision is adopted, the problem mentioned above can be predicted in advance. That is, when the device sends a detection signal from the printer to a personal computer or a print image output instruction system, an appropriate step can be taken.

One of the methods for preventing the above problem is to visually display the amount of remaining ink by changing an indication color. The printers are not always attended by an operator and thus when a necessary signal is to be transferred through a network or online transmission to a remote location (as by facsimile), it's self-evident that simply displaying the amount of ink used (remaining amount) cannot cope with the event described above.

To solve this problem, a method has been proposed as shown e.g., in Japanese Patent Application Laid-open Nos. 34967/1982 and 204565/1984, in which a change in the amount of ink consumed is measured by cutting of the a conductive member disposed between the ink bag and the case with contraction of the ink bag in response to displacement or deformation of the ink bag resulting from ink consumption this method is a system which is cut off or opened when the final stage or its vicinity of ink consumption (minimum amount of remaining ink) is reached, thus making it possible to detect the amount of ink consumed or the amount of remaining ink easily and more reliably.

The ink remaining amount detection device of a type that cuts off or opens the conductive member, for example as shown in FIGS. 15A and 15B, includes: a conductive member 20 having its intermediate portion in contact with the surface of the ink bag 16 through an opening 14*a* of an ink tank case 14 installed in an ink tank accommodating portion 26; clips 18A and 18B connected to the ends of the conductive member 20; and a detection circuit having electrodes electrically connected to the clips 18A and 18B, respectively.

The inside of one end of the ink bag 16 communicates with an ink supply passage 26*a* through a stationary needle 22 and an elastic member 24. The ink bag 16 is pushed down by a press member 28 through an opening 26*a* provided in the ink tank accommodating portion 26.

In this construction, as the ink in the ink bag 16 is consumed, the ink bag 16 pressed by the press member 28 contracts and the intermediate portion of the conductive member 20 moves together with the surface of the ink bag 16. When the conductive member 20 is cut off, the resistance between the clips 18A and 18B becomes infinite, with the result that the detection circuit decides that the amount of ink remaining in the ink bag 16 is less than a predetermined value.

In the ink remaining amount detection system based on the circuit opening, however, a predetermined pressing force needs to be applied by the press member 28 for enhanced precision of the measurement. Variations in the pressing force from the press member 28 may undesirably cause the ink in the ink bag 16 to flow out through the stationary needle 22 and the elastic member 24 into the ink supply passage 26*a*.

Further, to ensure that a change in the amount of ink consumption can be precisely measured at around the final point in the ink consumption (near the minimum amount of remaining ink), the displacement or deformation up to the final point in the ink consumption must be constant at all times. To realize this, a predetermined urging force needs to be applied to the ink bag 16.

The experiments conducted by the inventor of this invention have found that this urging force is about 98.0 Pa (reference value: 1 g/cm$^2$) or larger when the ink bag is made from a polyethylene film 0.1 mm thicknessr and the stationary needle 22 has an outer diameter of 2 mm. When the ink bag is formed of a multilayer film of, for example, aluminum foils and silica composite films and the similar stationary needle 22 is used, the urging force is found to be about 147.0 Pa (reference value: 1.5 g/cm$^2$) or larger based on an experiments conducted by the inventor of this invention.

The urging force depends on the surface tension of ink, the dimensions of an ink discharge port of the ink bag, and the material of the bag. When the ejection opening of the ink jet print head are around 20 $\mu$m in diameter and if an ink pressure of about 245 Pa (reference value: about 2.5 g/cm$^2$) is applied, then the ink may leak out of the ejection opening of the print head.

If the ink bag filled with ink is 1 cm or more in thickness, the ink is likely to leak. Because the ink jet print head has pressure variations, which depend on the sliding, moving and vibrating motions, the ink is supplied to the print head generally under the pressure of −1 cm head (negative 1 cm head or more).

This requires the ink bag to be arranged at a position far below the ink jet print head in the gravity direction (more than 6 cm below). Below the print head there is generally a printing medium such as paper, which makes it impossible to install the ink bag beneath the ink jet print head.

Another possibility is placing the ink bag at a position much lower than the print head and connecting the bag to the ink jet print head through a connection pipe to supply ink to the print head.

Because the ink pressure in an ink passage running from the ink bag at its lower end to the ink jet print head at its higher end cancels the ink bag collapsing force, the urging force needs to be set that much higher. This system therefore is practically not usable. Setting the ink bag vertically erect is, of course, totally impracticable. With this method, the ink bag cannot be put at a position above the print head or at a position equal to or higher than the plane on which the print head is arranged. To solve this problem requires some provision at the discharge port of the ink bag which can withstand these pressures, prevent leakage and supply ink in a predetermined quantity.

In the method that arranges some conductive member between the ink bag and the case and determines the ink consumption or the remaining amount of ink based on a change in the gap between the ink bag and the case, this problem may be solved by adopting an ink bag construction in which an ink passage valve capable of withstanding the above-described urging force and supplying ink to the print head is integrally installed at the discharge port of the ink bag. To detect the gap change accurately, the urging force of about 98.0 Pa (reference value: 1 g/cm$^2$) or more needs to be applied.

(1) A basic construction based on the provisions described above was manufactured. It has been found that because the ink bag is soft, the conductive member cannot be put in its place easily even by placing the rigid flat plate (e.g., iron plate) on the outer circumferential surface of the ink bag. Further, when the conductive member is made from a coiled spring or leaf spring, it is kept in a deformed state. Hence, in long-term storage or distribution tests accompanied by temperature and humidity changes, the conductive member is found unable to get cut off at a predetermined position and creep deformations cause it to get cut off before it reaches the predetermined position, which is undesirable.

It is therefore very difficult to put such a turn-off contact mechanism in place with high reliability. Automating the assembly of the mechanism and securing a long-term reliability are also difficult to achieve.

(2) In such a turn-off contact system, the output potential level changes from a high level "H" to a low level "L". The system has a drawback that the current flows at all times until the minimum amount of remaining ink is detected (energy loss). A visual display of any kind cannot be made directly from a status change of the signal from "H" to "L". To make some kind of visual indication requires an inversion circuit and an amplification circuit. In the turn-off contact system that changes the signal level from "H" to "L", if the above-described conductive member is directly used to issue a warning of the residual ink amount with a light emitting diode (LED), the turn-off contact system needs to have an inversion circuit (made up of transistors) for inverting the signal and also an adjustment resistor, thus, the structure is not only complex, the structure also increases the cost of the product.

With a view to overcoming the above problems, it is an object of the present invention to provide a print liquid tank for supplying a print liquid to a print head that prints on a printing medium and a printing apparatus having the print liquid tank, wherein the print liquid tank can easily and precisely detect the amount of ink remaining in the ink tank and directly produce digital signals representing the remaining amount of ink without using a conversion element such as an A/D converter or D/A converter.

SUMMARY OF THE INVENTION

To achieve the above objective, the print liquid tank according to the present invention comprises: a storage portion made from a flexible material to be contractible or expandable, the storage portion storing a predetermined amount of print liquid and discharging the print liquid; a pressing member for pressing against the storage portion; an electrode member having an electrode portion, the electrode portion having one of its ends connected to an outer circumferential portion of the storage portion, the outer circumferential portion contracting as the print liquid is consumed, the electrode portion representing a consumption level of the print liquid; a contact electrode unit electrically connected to the electrode portion of the electrode member to issue a detection output representing the consumption level, when the contact electrode unit being moved relative to the electrode portion of the electrode member as the print liquid is consumed, the contact electrode unit detecting when a predetermined consumption level or more is consumed and issuing the detection output; and a on-off control valve provided in the storage portion to control discharging of the print liquid.

The printing apparatus having the print liquid tank according to the present invention comprises: the print liquid tank according to claim 1; a printing portion supplied with a print liquid from the print liquid tank and ejecting the print liquid to perform a print operation; and a controller to control the control valve and issue an output representing the liquid consumption in the storage portion according to the detection output from the contact electrode unit.

As can be seen from the foregoing description, the print liquid tank of this invention and the printing apparatus having the print liquid tank include: an electrode member having a plurality of electrode portions, the electrode portions having one of their ends connected to an outer circumferential portion of the storage portion, the outer circumferential portion contracting as the print liquid is consumed, the electrode portions being moved according to the liquid consumption level; and a contact electrode unit electrically connected to the electrode portions of the electrode member to issue a detection output representing the consumption level, when the contact electrode unit being moved relative to the electrode portions of the electrode member as the print liquid is consumed, the contact electrode unit detecting when a predetermined consumption level or more is consumed and issuing the detection output. Because of this construction, the amount of ink remaining in the ink tank can be detected easily and precisely and a signal representing the remaining amount of ink can be directly obtained without using a conversion element such as a converter.

The above and other objects, effects, features and advantages of the present invention will become more apparent from the following description of embodiments thereof taken in conjunction with the accompanying drawings.

BRIEF DESCRIPTION OF THE DRAWINGS

FIG. 10 is a table used to explain the operation of the example of FIG. 6;

DESCRIPTION OF PREFERRED EMBODIMENTS

Figure 6:
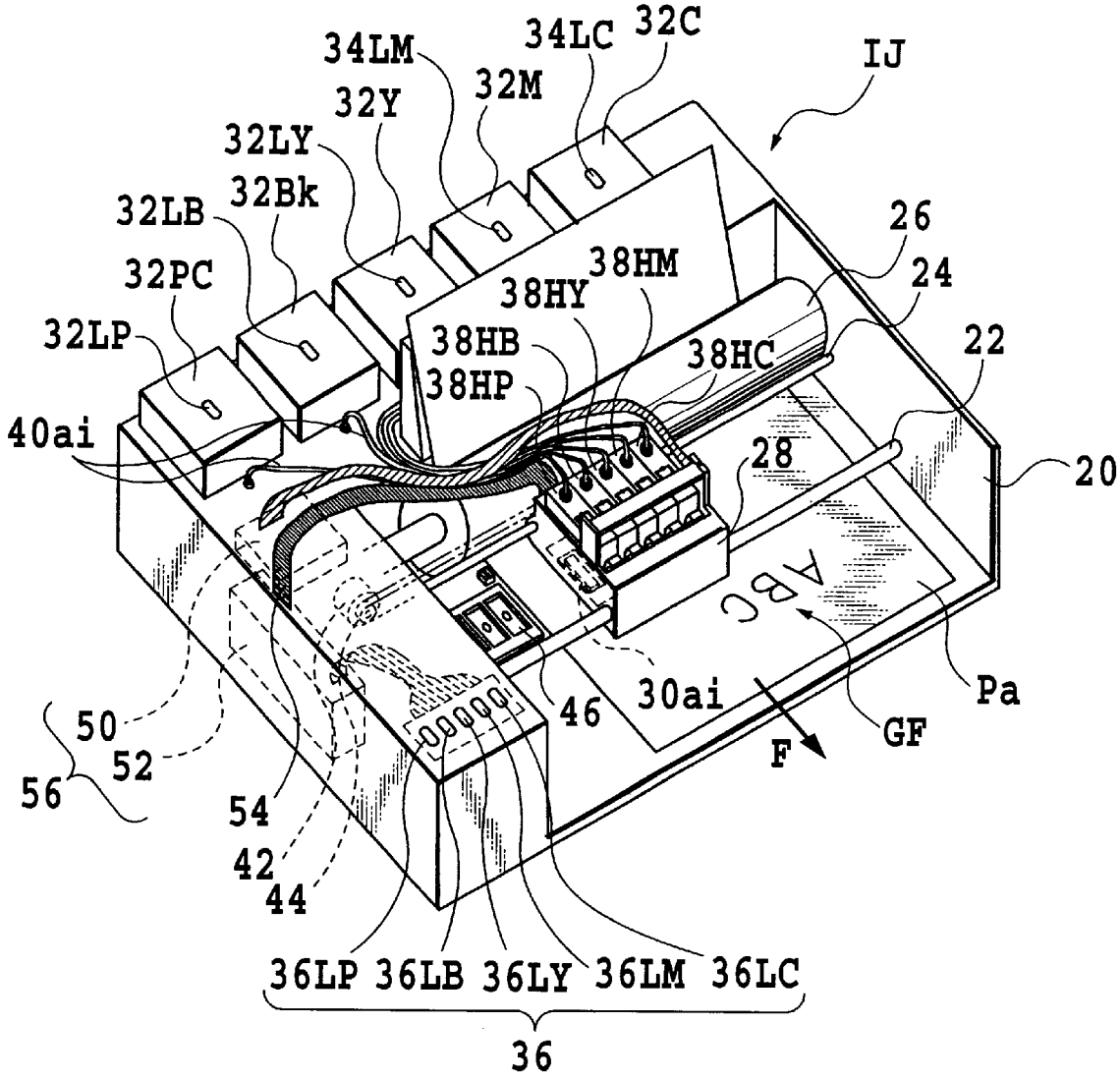
FIG. 6 is a perspective view showing an overall construction of one example of the printing apparatus having the print liquid tank according to the invention.

FIG. 6 schematically shows an example of the printing apparatus having the print liquid tank according to this invention.

The example shown in FIG. 6 is, for example, an ink jet printer having a print head unit 38 that prints on a recording surface of a sheet Pa as a printing medium.

The ink jet printer IJ has as main constitutional elements a carriage member 28 reciprocally moved and carrying the print head unit 38, ink tanks 32C–32PC for supplying inks of predetermined colors or a process liquid to print heads 38HC–38HP of the print head unit 38 detailed later, and a paper feed roller unit 26 for feeding the paper Pa to a predetermined position below the print head unit 38.

The carriage member 28 is slidably supported on guide shafts 22 and 24 disposed parallel to and facing each other. The guide shafts 22 and 24 extending virtually perpendicular to the direction of arrow F or paper Pa feed direction described later are supported at their ends by side walls of a chassis 20. The guide shafts 22 and 24 are inserted through holes formed in a base portion of the carriage member 28.

The carriage member 28 has a print head accommodating portion in which to install the print head unit 38. The carriage member 28 is connected with a transport belt 44 that extends along the axes of the guide shafts 22 and 24. The transport belt 44 is wound around a pair of pulleys. One of the paired pulleys is coupled to an output shaft of a drive motor 42. Thus, when the drive motor 42 is in operation, the carriage member 28 carrying the print head unit 38 is made to reciprocate over a predetermined distance corresponding to a print area covered by the print head unit 38.

Figure 8:
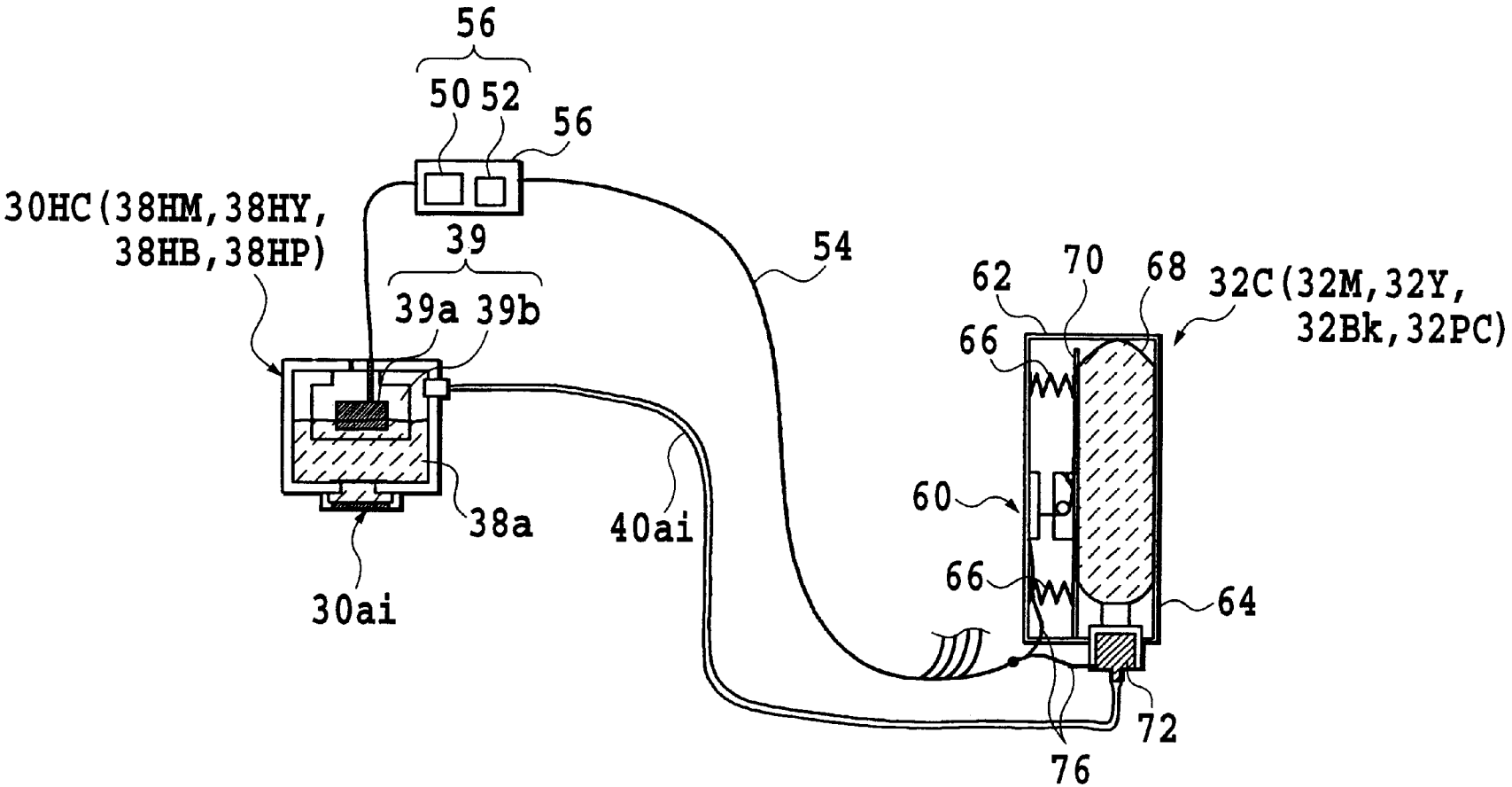
FIG. 8 is a piping diagram showing piping between the ink tank and the print head used in the example of FIG. 6.

The print head unit 38 has print heads 38HC, 38HM, 38HY, 38HB and 38HP that eject cyan, magenta, yellow and black inks and a process liquid for making the inks insoluble. The print heads 38HC–38HP are of the same structure each other and, as shown in FIG. 8, have a subtank 38*a* each for storing an ink of the associated color. The subtank 38*a* has an ink demand sensor 39 that detects the presence or absence of a predetermined amount of residual ink and issues a corresponding detection output. The ink demand sensor 39 has a pair of electrodes 39*a*, 39*b* disposed to face each other at a position corresponding to a predetermined level of ink in the subtank 38*a*. The print heads 38HC–38HP are of a bubble jet type and have a liquid ejection portion 30*ai* each which ejects an ink or process liquid onto the recording surface of the sheet Pa fed beneath the carriage member 28. The liquid ejection portion 30*ai* has electrothermal transducers provided one in each liquid passage communicating with associated one of a plurality of liquid ejection opening. The liquid ejection portions 30*ai* are controlled based on a drive control pulse signal from a print operation controller described later.

Each subtank 38*a* is connected with one end of a liquid supply passage 40*ai* (i=1–5) through which to introduce the ink or process liquid from the ink. tank described later.

At a predetermined home position spaced from the print operation area of the print head unit 38, there is provided an ejection performance recovery unit 46 that recovers the ejection performance of the print head unit 38, as shown in FIG. 6.

The paper feed roller unit 26 comprises a pair of feed rollers and a drive motor for rotating the feed rollers. The drive motor is controlled by a drive control signal from a control unit described later. Thus, as the drive motor is operated, one end of the paper Pa is fed in the direction of arrow F in FIG. 6 to a position below the print head unit 38, at which time the print heads 38HC–38HP perform printing operations to form an image GF on the recording surface of the paper Pa.

The ink tanks 32C, 32M, 32Y, 32Bk and 32PC contain cyan, magenta, yellow and black inks and a process liquid, respectively. Because the ink tanks 32C, 32M, 32Y, 32Bk and 32PC are of the same construction each other, only the ink tank 23*c* will be described and explanations on other ink tanks omitted.

Figure 3:
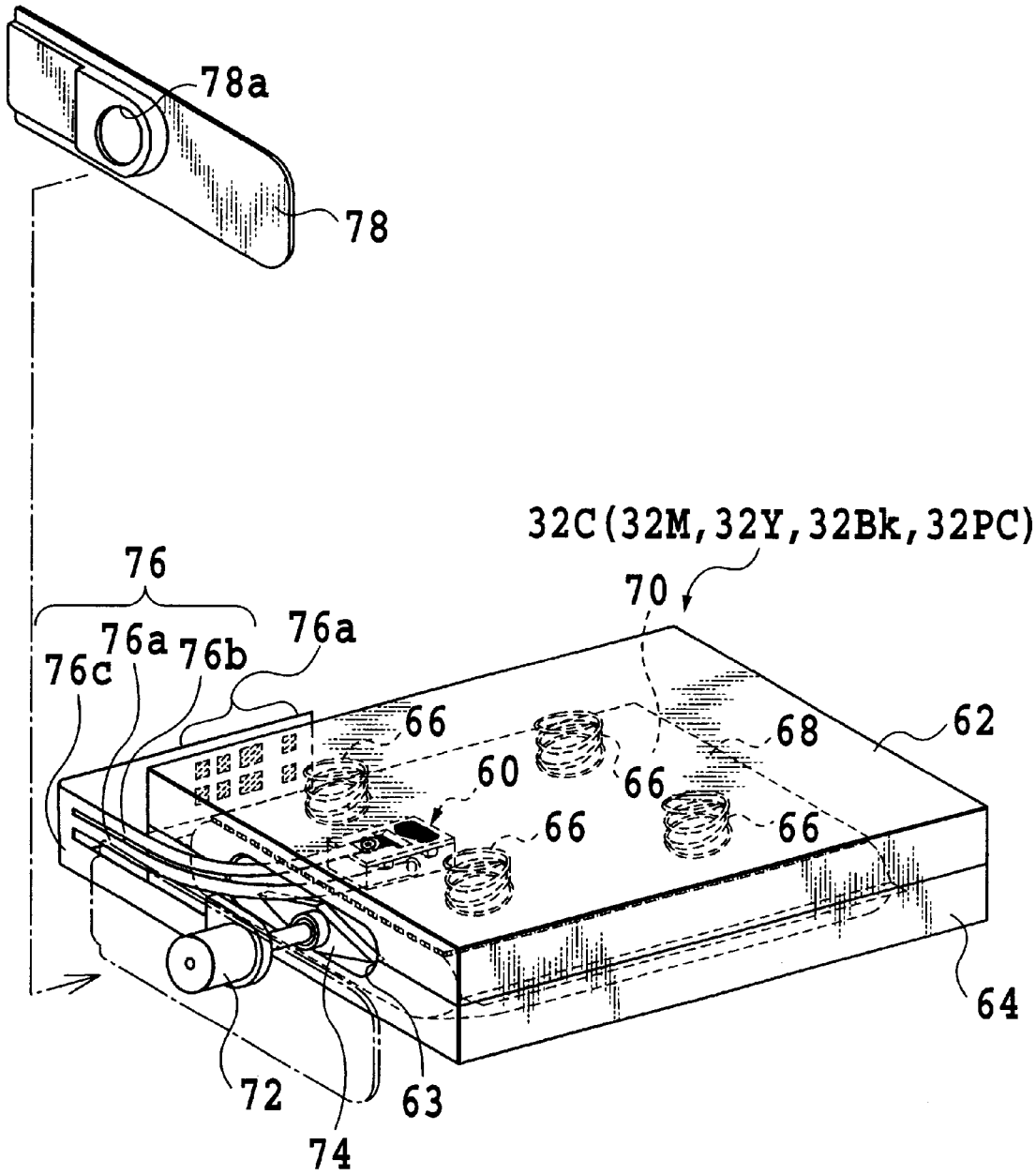
FIG. 3 is a perspective view showing one example of a print liquid tank according to the invention.

The ink tank 32C, as shown in FIG. 3 and FIG. 8, comprises tank cases 62, 64 forming an enclosure, an ink bag 68 as an ink container installed in the tank cases 62, 64, a plate member 70 placed in contact with the outer circumferential surface of the ink bag 68 and dividing the interior of the tank cases 62, 64 into two, an on-off valve 72 provided at the discharge port of the ink bag 68 to control the amount of ink supplied, and an ink consumption detection unit 60 for detecting the ink consumption in the ink bag 68.

The tank cases 62, 64 are each injection-molded from polyphenylene oxide (trademark: XYLON of ASAHI KASEI. corp make) with relatively high rigidity. The tank cases 62 and 64 are integrally joined together by ultrasonic welding. One of the outer surfaces of the ink bag 68 is placed in contact with the inner surface of the tank case 64 and the plate member 70 is bonded to the other outer surface of the ink bag 68.

Between the plate member 70 made from a relatively rigid metal material and the inner surface of the tank case 62 there are coil springs 66, for example at four locations, which urge the ink bag 68 in a direction that contracts it as the ink is consumed. The plate member 70 is, for example, an iron plate 0.5 mm thickness considering the machinability, availability and economy. The plate member 70 is not limited to the iron plate but may be any other materials as long as they have a relatively high rigidity, such as a plastic plate.

Because the ink bag 68 is a flexible bag, the plate member 70 is necessary to ensure that the ink bag 68 is contracted uniformly, without being deformed partially, by the urging force of the coil springs 66. The ink consumption detection unit 60 described later is arranged at a predetermined position on one surface of the plate member 70.

The ink bag 68 is formed from a laminated film consisting of an inner layer and an outer layer fused together by heat, the inner layer having an oriented polypropylene film (of Nippon Kim make) 12 $\mu$m thickness and an aluminum foil film 9 $\mu$m thickness stacked over the polypropylene film, the outer layer having an oriented nylon film 16 $\mu$m thickness. The ink bag 68 is filled with, for example, 45 ml of cyan ink. It has been verified that even when subjected to an external pressure of about 1 atmosphere, the ink bag 68 whose thermally welded portion is about 3 mm or more wide is not broken to leak the ink.

A joint member 74 injection-molded from polypropylene is joined to the discharge port side of the ink bag 68. The joint member 74 has an on-off valve 72. The joint member 74 and the on-off valve 72 protrude outside through an opening 63 provided in the joined part of the tank cases 62 and 64.

Figure 4:
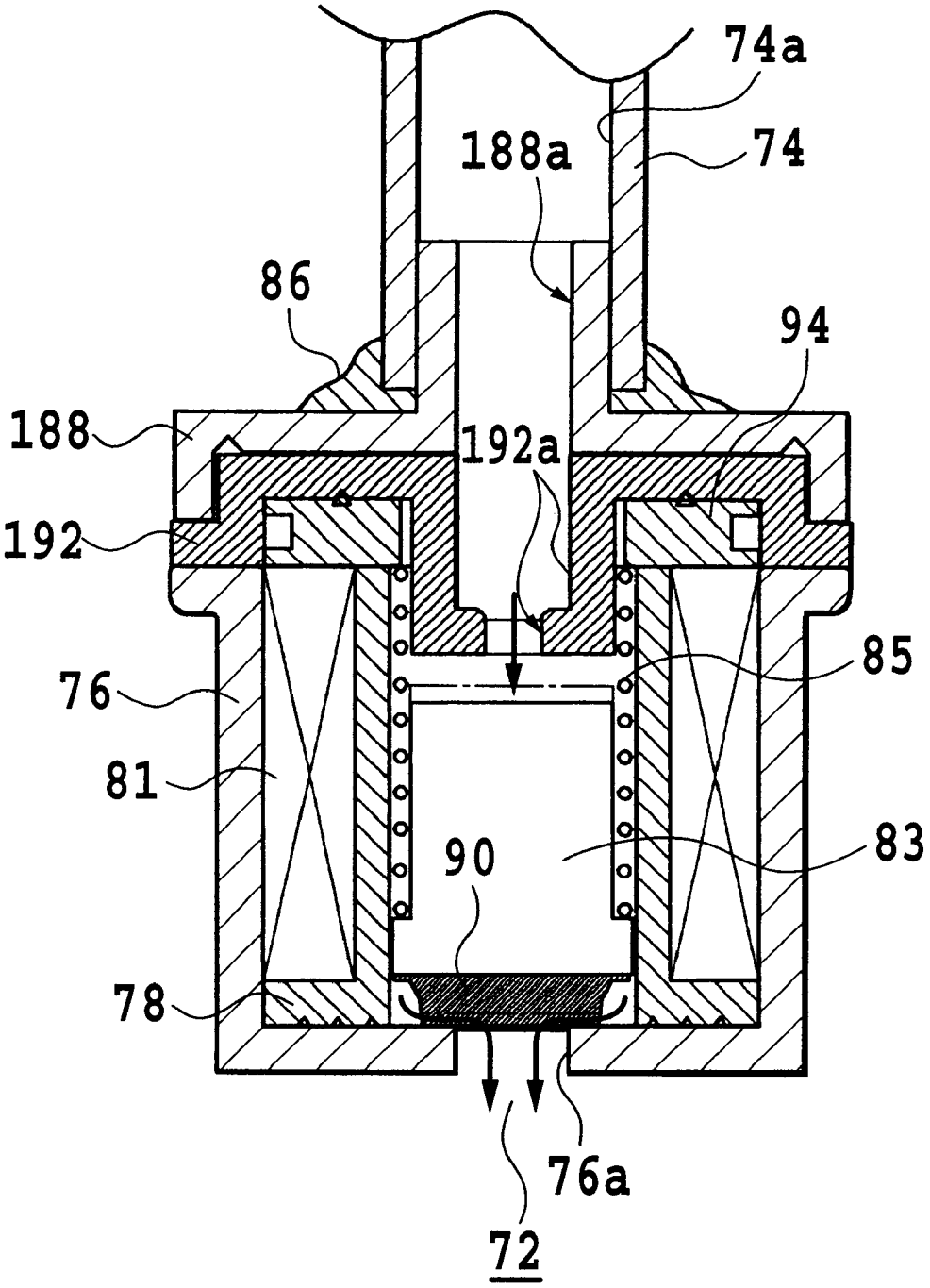
FIG. 4 is a cross section of an on-off valve used in the example of FIG. 3.

The on-off valve 72, as shown in FIG. 4, comprises as its main constitutional elements a valve base 188 connected to an ink discharge passage 74*a* of the joint member 74; a cap member 76 secured to the valve base 188 through a seal housing 192 and having a discharge opening 76*a*; a coil 81 installed in the cap member 76; a coil case 78 supporting the coil 81; and a valve disc 83 movably installed in that part of the coil case 78 communicating with the ink discharge passage 74*a* and controlled to open and close the discharge opening 76*a*.

Inside cylindrical portions of the valve base 188 and the seal housing 192 are formed through-holes 188*a* and 192*a* that communicate with the ink discharge passage 74*a*.

Thus, an ink passage in the on-off valve 72 is formed by the through-holes 188*a*, 192*a*, a clearance between the outer circumferential surface of the valve disc 83 and the inner surface of the coil case 78, and the discharge opening 76*a*.

A seal member 94 is installed in a recess on the outer side of the cylindrical portion of the seal housing 192. A coil spring 85 urging the valve disc 83 toward the discharge opening 76*a* is installed between the valve disc 83 and the outer side of the cylindrical portion of the seal housing 92.

For example, the valve disc 83 formed of a ferromagnetic material has an touch portion 90 that selectively engages a circumferential edge of the inner side of the discharge opening 76*a* inside the cap member 76.

The coil 81 is energized or deenergized by the drive control signal from the control unit described later.

Accordingly, when the coil 81 is energized, the touch portion 90 of the valve disc 83 is parted from the inner surface of the cap member 76 against the urging force of the coil spring 85. Hence, the discharge opening 76*a* is open. When on the other hand the coil 81 is deenergized, the touch portion 90 of the valve disc 83 is brought into contact with the inner surface of the cap member 76 by the urging force of the coil spring 85. The discharge opening 76*a* therefore is closed. The discharge opening 76*a* of the on-off valve 72 communicates with the subtank 38*a* through the ink supply passage 40*ai* (i=1–5). Thus, when the discharge opening 76*a* is open, a predetermined amount of ink is supplied into the subtank 38*a*.

With the on-off valve 72 so constructed that the higher the inner pressure, the more firmly the valve is closed, there is no possibility of ink leakage. Because the on-off valve 72 can be opened and closed up to the inner pressure of two atmospheres, the ink supply and cutoff can be performed well.

When the on-off valve 72 is driven at about 8V and 50 mA, its response time is approximately 0.05 seconds. In that case, the amount of ink supplied is about 0.5 ml/sec for 3,920 Pa (reference value: 40 g/cm$^2$).

The ink consumption by the ink jet printer for a general photographic image is, for example, about 0.05 ml/sec/color at most depending on the number of nozzles of the ink jet print head and the drive frequency. Thus, the on-off valve 72 can easily meet the requirement of the ink jet print head.

A flexible electrode plate 76 electrically connected to the ink consumption detection unit 60 described later and to the on-off valve 72 is secured as by a caulking joint or bonding agent to a side surface of the tank cases 62, 64 perpendicular to the side surface in which the opening 63 is formed, as shown in FIG. 3. The flexible electrode plate 76 is a conductive plate having copper wires formed by plating or ion plating over a polyimide-based sheet film generally called a "flex". A protective coating layer is also formed over the copper wiring. The flexible electrode plate 76 is a planar electrode wire which has its joint terminal portion 76*a* exposed outside for connection with a connector of a flexible cable 54.

As shown in FIG. 3, a support plate 78 closing the opening 63 is provided to the side surface of the tank cases 62, 64. The on-off valve 72 is inserted into a through-hole 78*a* of the support plate 78 and the flexible electrode plate 76 is clamped between the support plate 78 and the outer surfaces of the tank cases 62, 64, thus holding the on-off valve 72 and the flexible electrode plate 76 firmly in their place.

Figure 1:
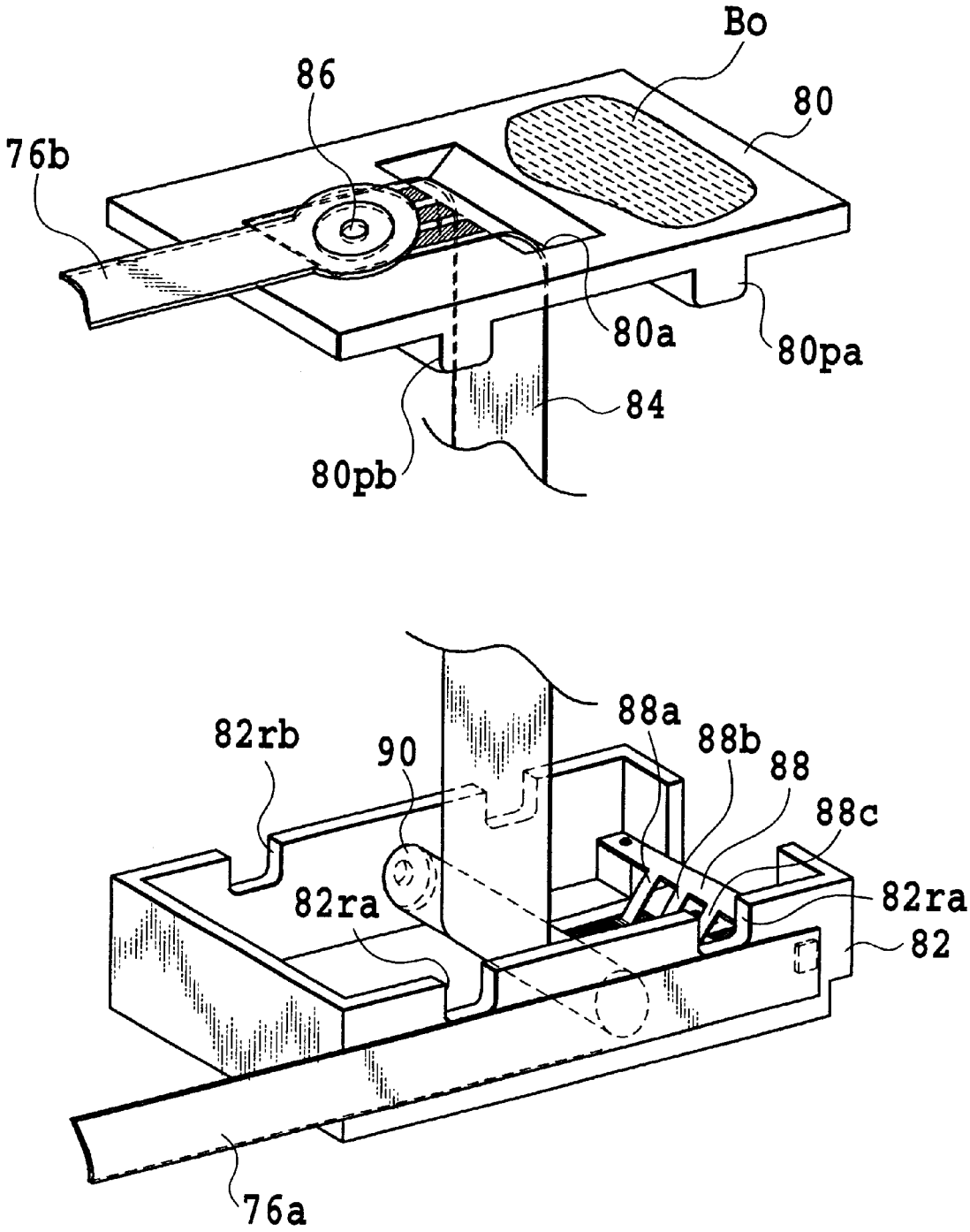
FIG. 1 is an exploded perspective view showing a construction of an ink consumption detection unit used in one example of a print liquid tank and a printing apparatus having the print liquid tank according to the invention.

The ink consumption detection unit 60 disposed between the plate member 70 and the inner surface of the tank case 62 comprises as its main constitutional elements a tape holding plate 80 secured to the inner surface of the tank case 62, a contact electrode holding case 82 facing the tape holding plate 80 and secured to the plate member 70, and a contact tape 84 disposed between the tape holding plate 80 and the contact electrode holding case 82 and having its ends connected to the tape holding plate 80 and the contact electrode holding case 82, as shown in FIGS. 1 and 8.

The tape holding plate 80 molded from, for example, high density polyethylene is bonded to the inner surface of the tank case 62 by a bonding agent Bo applied to one of planar surfaces of the plate 80. The tape holding plate 80 has a through-hole 80*a* through which to insert one end of the contact tape 84. The tape holding plate 80 also has a pin member 86 adjacent to the through-hole 80*a*.

The pin member 86 secures to the tape holding plate 80 by a thermal caulking joint one end of the contact tape 84 passing through the through-hole 80*a* and a terminal 76*b* of the flexible electrode plate 76. On the other planar surface the tape holding plate 80 has raised portions 80*pa*, 80*pb* as position restriction members spaced apart by a predetermined distance.

The contact electrode holding case 82 formed of, for example, high density polyethylene is bonded to the plate member 70 as by a bonding agent. At one inner end of the contact electrode holding case 82 is provided a contact electrode plate 88 which movably supports electrode surfaces formed at the other end of the contact tape 84 described later. The contact electrode plate 88 having branch electrodes 88*a*, 88*b*, 88*c* formed from a phosphor bronze plate is arranged inside the contact electrode holding case 82 by a caulking joint. The branch electrodes 88*a*–88*c* of the contact electrode plate 88 press against the contact tape 84 at all times. A common electrode portion of the contact electrode plate 88 is electrically connected to the terminal portion 76*a* of the flexible electrode plate 76.

Inside the contact electrode holding case 82 is provided a guide pin 90 spaced from the contact electrode plate 88 by a predetermined distance. Both ends of the guide pin 90 are supported on side walls of the contact electrode holding case 82. The outer circumferential surface of the guide pin 90 stabilizes and guides the moving contact tape 84.

At a circumferential part of the opening facing the tape holding plate 80, the contact electrode holding case 82 has recesses 82*ra*, 82*rb* that receive the raised portions 80*pa*, 80*pb* of the tape holding plate 80.

Figure 2:
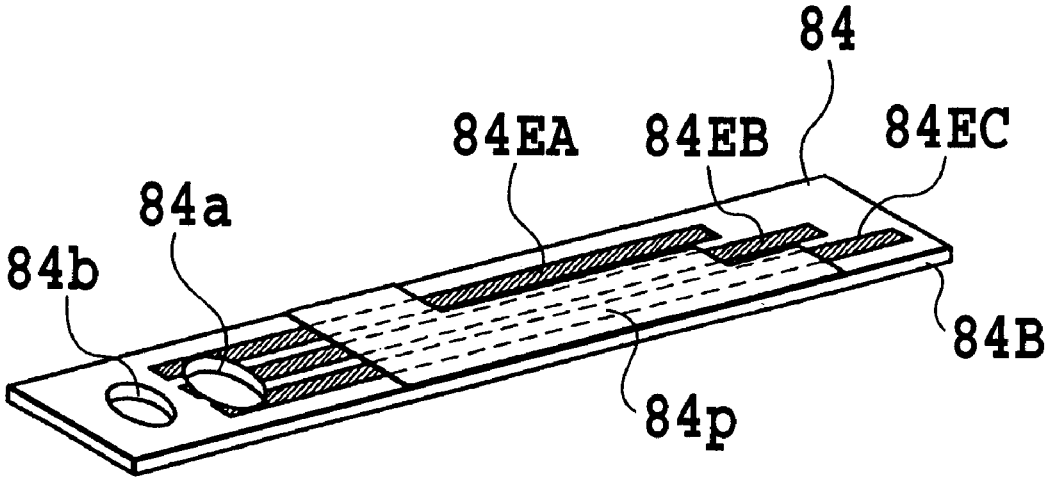
FIG. 2 is a perspective view showing a contact tape used in the example of FIG. 1.

The contact tape 84, as shown in FIG. 2, has contact electrodes 84EA, 84EB, 84EC formed by screen-printing an ohmic resistant carbon paste or by carbon evaporation over the surface of a polyester film 84B 0.1 mm thickness. The contact tape 84 has through-holes 84*a*, 84*b* punched out at one end of the contact electrodes 84EA, 84EB, 84EC. The contact electrodes 84EA, 84EB, 84EC with resistances of about 50–1500Ω are formed parallel to one another at predetermined intervals. The contact electrodes 84EA, 84EB, 84EC having different lengths are formed so that their positions at one end are aligned. The contact electrode 84EA is set to be shortest, the contact electrode 84EC longest, and the contact electrode 84EB intermediate in length.

Further, the contact electrodes 84EA, 84EB, 84EC are partly covered with an insulating layer 84P. The insulating layer 84P is formed stepwise corresponding to the contact electrodes 84EA, 84EB, 84EC by using, for example, an insulating paste (ultraviolet curing nk paste). At one end of the insulating layer 84P on the through-hole 84*a* side, the ends of the contact electrodes 84EA, 84EB, 84EC are exposed over the same lengths. The insulating layer 84P has its portion corresponding to the contact electrode 84EA formed shortest, its portion corresponding to the contact electrode 84EC formed longest and its portion corresponding to the contact electrode 84EB formed intermediate in length between the former two portions.

One end of the contact tape 84 is joined, through thermal caulking, to the terminal 76*b* by insertinging the above pin member 86 into the through-hole 84*b*. The other end of the contact tape 84, after passing through the through-hole 80*a* and engaging the guide pin 90, is movably held by the contact electrode plate 88.

When the ink in the ink bag 68 is not consumed, with the tape holding plate 80 and the contact electrode holding case 82 close to each other, the branch electrode 88*a* of the contact electrode plate 88 is directly in contact with the contact electrode 84EA and the branch electrodes 88*b* and 88*c* are in contact with the insulating layer 84P.

Next, when the tape holding plate 80 and the contact electrode holding case 82 begin to move away from each other as the ink in the ink bag 68 is consumed, the contact electrode 84EA moves in sliding contact with the branch electrode 88*a* of the contact electrode plate 88 and then comes out of contact. At the same time, the other contact electrodes 84EB, 84EC move out of the non-contact state into a direct contact with the branch electrodes 88*b*, 88*c*, one after another, according to the distance traveled.

Then, when, according to the ink consumption in the ink bag 68, the tape holding plate 80 and the contact electrode holding case 82 are parted by the maximum distance, the contact electrodes 84EA–84EC are out of contact with the branch electrodes 88*a*, 88*b*, 88*c*.

In the case of the ink bag 68 filled with 40 ml of ink, for example, the lengths of the exposed contact electrodes are set as follows. The contact electrode 84EA is exposed from the insulating layer 84P, beginning with a predetermined position, over a range corresponding to the ink consumption of 0–35 ml and its exposed portion terminates at a position corresponding to the ink consumption of 35 ml. The contact electrode 84EB is exposed over a distance ranging from a position corresponding to the ink consumption of 30 ml to a position corresponding to the ink consumption of 38 ml. The exposed part of the contact electrode 84EC begins at a position corresponding to the ink consumption of 37 ml and ends at a position corresponding to the ink consumption of 39.5 ml.

Figure 9:
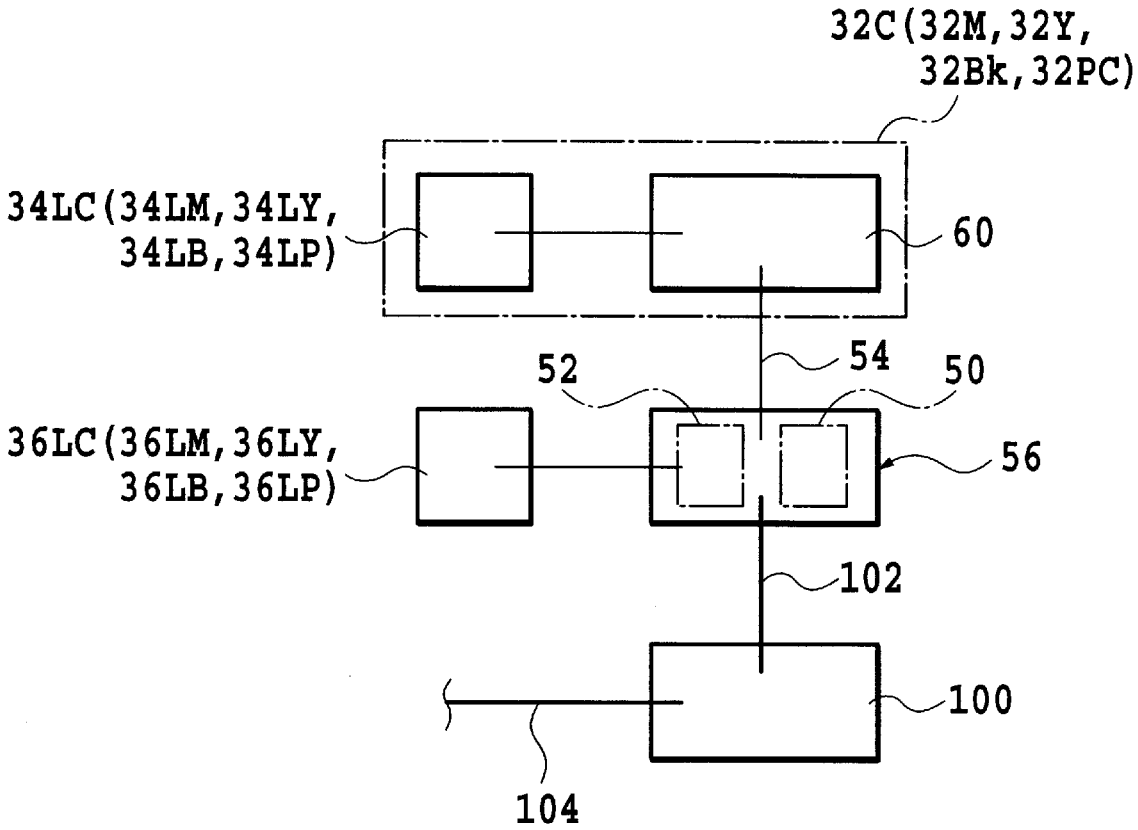
FIG. 9 is a block diagram showing a configuration of a control system used in the example of FIG. 6.

The ink tank 32C also has an LED lamp 34LC as an ink consumption indication lamp, as shown in FIG. 1 and FIG. 9. The LED lamp 34LC has, for example, three color LED elements and lights up in blue, blue-green, yellow-green, orange and red, for instance.

Figure 5A:
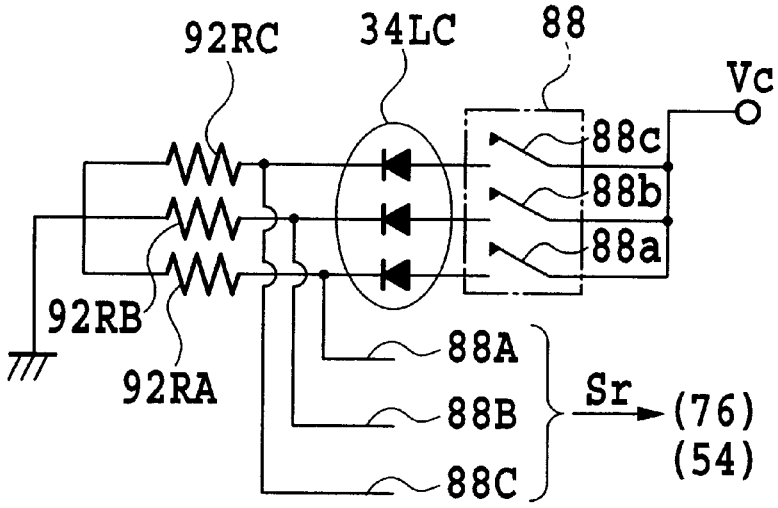
FIGS. 5A and 5B are circuit diagrams showing detection circuits including contact electrode plates and LED lamps.

The ink consumption detection unit 60 also has a signal forming circuit electrically connected to the contact electrode plate 88, as shown in FIG. 5A.

The signal forming circuit includes: a voltage source Vc that applies a predetermined voltage to the branch electrodes 88*a*, 88*b*, 88*c* connected in series with the associated LED elements of the LED lamp 34LC; and resistor elements 92RA, 92RB, 92RC connected in series with the associated LED elements of the LED lamp 34LC. The voltage source Vc may, for example, be a DC voltage source of the voltage between or equal to 5 and 24 V.

The resistor elements 92RA, 92RB, 92RC are grounded at one connection end. The resistances of these resistor elements 92RA, 92RB, 92RC are set to about 2 kΩ for example, respectively. Thus, when the branch electrodes 88*a*, 88*b*, 88*c* come into contact with the contact electrodes 84EA, 84EB, 84EC, making the circuit to a fixed contact connected to the LED lamp 34LC, high-level signals (H) are formed as shown in FIG. 10, respectively, turning on the associated LED elements of the LED lamp 34LC.

Conductive wires 88A, 88B, 88C electrically connected to a flexible cable 54 are connected at one end to connection points between the resistor elements 92RA, 92RB, 92RC and the LED elements of the LED lamp 34LC. The conductive wires 88A, 88B, 88C at one end may be connected to connection points between the LED elements of the LED lamp 34LC and the branch electrodes 88*a*, 88*b*, 88*c*.

An output signal Sr representing the ink consumption and generated according to the opening and closing of the circuits by the branch electrodes 88*a*, 88*b*, 88*c* are fed through the conductive wires 88A, 88B, 88C and the flexible cable 54 to the control unit 56 described later.

Thus, the contact electrode unit comprises the contact electrode plate 88, the voltage source Vc, the resistor elements 92RA, 92RB, 92RC, and the conductive wires 88A, 88B, 88C.

Figure 5B:
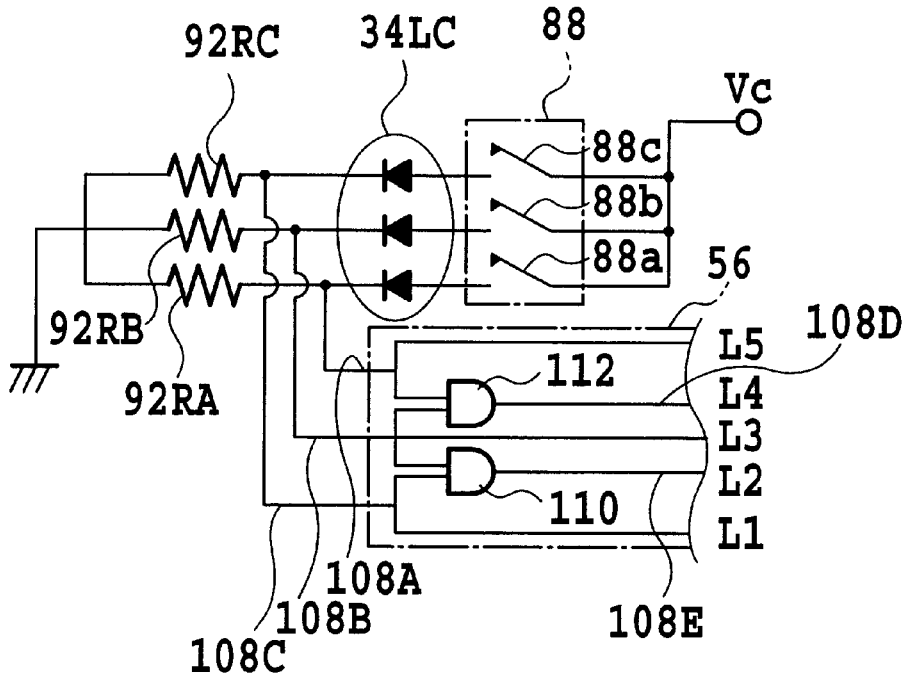

Although the example shown in FIG. 5A directly uses the signal from the conductive wires 88A, 88B, 88C, the signal may be extracted otherwise. For example, as shown in FIG. 5B, conductive wires 108A, 108B, 108C may be connected at one end to the connection points between the resistor elements 92RA, 92RB, 92RC and the LED elements of the LED lamp 34LC. In FIG. 5B, the constitutional elements identical with those of FIG. 5A are given like reference numerals and their explanations are omitted.

In FIG. 5B, between the conductive wire 108A and the conductive wire 108C are connected conductive wires 108D and 108E through AND elements 110, 112. The circuit of the AND elements 110, 112 may be a plurality of gate arrays or a gate array integrated circuit. Thus, signals L5, L4, L3, L2 and L1 can be obtained through the conductive wires 108A, 108B, 108C, 108D and 108E.

In this arrangement, the levels of the signals L5, L4, L3, L2, L1 change between the high level (H) and the low level (L), as shown in FIG. 10, as the contact electrode plate 88 moves in response to the ink consumption.

Figure 7:
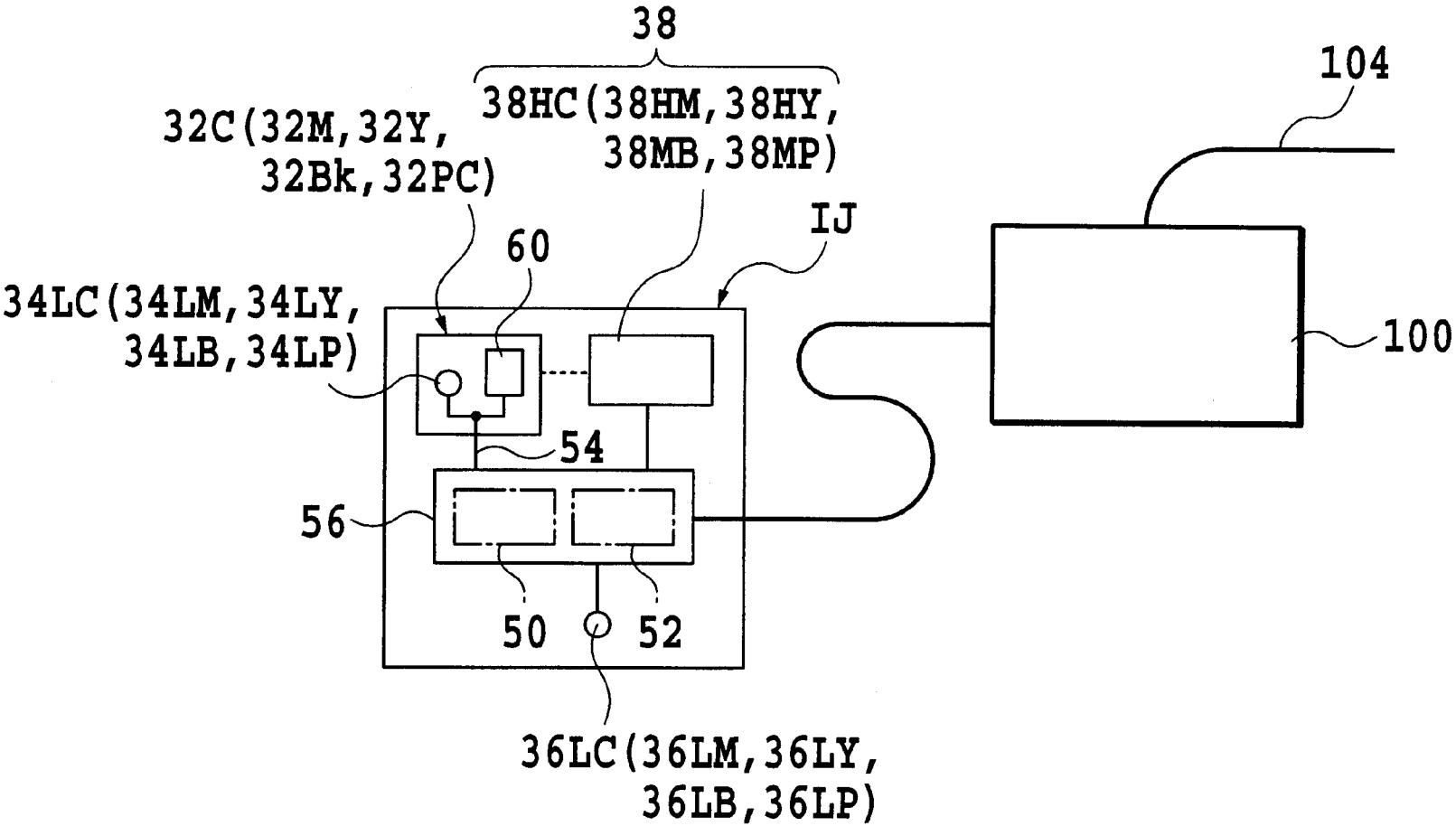
FIG. 7 is a block diagram showing a configuration of a control system used in the example of FIG. 6.

In one example of the printing apparatus having the print liquid tanks according to this invention, the control unit 56 that controls the print operation and monitors the remaining amount of ink in each ink tank 32C–32PC is provided as shown in FIG. 6 and FIG. 7.

The control unit 56 is electrically connected to a display portion 36 for indicating the ink consumption in each ink tank 32C–32PC. The display portion 36 has LED lamps 36LC, 36LM, 36LY, 36LB, 36LP corresponding to the ink tanks 32C–32PC. The LED lamps 36LC, 36LM, 36LY, 36LB and 36LP each have three color LED elements and light up in blue, blue-green, yellow-green, orange and red, for example.

The control unit 56 connected to the ink tanks 32C–32PC through the flexible cable 54 is supplied with an output signal Sr from each ink tank 32C–32PC and an ink demand signal from an ink demand sensor 39 of each print head 38HC–38HP . As shown in FIGS. 7 and 9, a host computer 100 connected to the ink jet printer IJ sends an operation state request signal, or an image data group and a system control data group to the control unit 56.

The control unit 56 includes a print operation controller 50 and an replenishing operation controller 52 having an internal memory for storing control data.

The print operation controller 50 forms a group of drive control pulse signals based on the received image data group and system control data group, and supplies the generated signals to the print head unit 38.

When the print heads 38HC–38HP consume more than a predetermined amount of ink during the print operation, the replenishing operation controller 52 generates a control signal based on the ink demand signal to open the on-off valve 72 for a predetermined duration and sends the control signal through the flexible cable 54 to each ink tank 32C–32PC. In response to the control signal, the on-off valve 72 opens the ink passage for a predetermined duration, causing the ink to flow out of the ink bag 68 by the pressure of the coil springs 66 into the subtank 38*a* through the liquid supply passage 40*ai*.

When the ink demand sensor 39 ceases to send the ink demand signal, the replenishing operation controller 52 stops supplying the control signal to the on-off valve 72, which then automatically closes the ink passage, stopping the supply of ink. This sequence of operations is repeated according to the consumption of ink or process liquid.

Further, according to the output signal Sr from each ink tank 32C–32PC, the replenishing operation controller 52 refers to a lookup table data representing the correspondence between lighting colors and consumptions, as shown in FIG. 10, and controls the on-off operation of the LED lamps 36LC, 36LM, 36LY, 36LB, 36LP.

FIG. 10 shows that when the consumption (ml) is 0–30, 30–35, 35–37, 37–38 and 39–39.5, the LED lamps are lighted in blue, blue-green, yellow-green, orange and red and that when the consumption is 40, they are turned off. FIG. 10 also shows whether the output signal Sr from the conductive wires 88A, 88B, 88C or signals L1, L2, L3, L4, L5 are high (H) or low (L) depending on the consumptions.

Thus, the LED lamps 36LC, 36LM, 36LY, 36LB, 36LP are made to change their lighting colors successively according to the consumption of the ink or process liquid in the ink tanks 32C–32PC. At the ink tanks 32C–32PC, the LED lamps 34LC–34LP are also made to change their lighting colors successively according to the consumption of the ink or process liquid in the each ink tanks. Further, the LED lamps 34LC–34LP may be provided alone without the LED lamps 36LC–36LP, if display portion 36 is provided in the ink tank.

For example, if an instruction manual of the printer explains that an LED lamp lit in red indicates that the ink is running out and the ink tank needs to be replaced, a trouble resulting from the lack of ink can be avoided by replacing the ink tank in question.

Further, as shown in FIGS. 7 and 9, because the control unit 56 is connected to the host computer 100 through a bidirectional communication line 102, it is monitored at predetermined intervals by the host computer 100. The host computer 100 receives ink consumption data in a predetermined order from the replenishing operation controller 52 of the control unit 56, the ink consumption data being generated based on the output signal Sr from the ink tanks 32C–32PC or on signals L1, L2, L3, L4, L5. The ink consumption data is made up of 3 bits or 5 bits of data.

Based on the ink consumption data, the host computer 100 of a known configuration generates a display signal representing the content to be displayed, as shown in FIG. 10, and displays it on the display portion and issues an alarm. The display content shown in FIG. 10 raises a level of caution progressively as the consumption range shifts. That is, as the consumption increases, the display prompts the user to replace the ink tank and, at the final stage, it displays a print stop command and sounds an alarm. For example, when the ink consumption (ml) is in a range of 39–39.5, the display unit displays a message reading "Ink is running out; replace ink tank" for each of the ink tanks.

Let us consider a case where the host computer 100 is linked to a network via an external communication line 104.

When an external computer on the network makes an access to the host computer 100 to check the consumption state in the ink tanks, the host computer 100 needs only to send out the ink consumption data. It is, however, important that the external computer on the network use software that can analyze the ink consumption data. When such software is not used, the external computer can only make a rough diagnosis, for example, determining only whether some abnormal condition exists, but cannot check the level of remaining ink.

When the external computer on the network is in operation and, based on the ink consumption data, recognizes that the ink consumption in one of the ink tanks is at a level shown in FIG. 10 that requires the replacement of the ink tank, it is possible to automatically make arrangements for delivering a replacement ink tank. Hence, the monitoring for maintenance of the ink tanks can be performed by the external computer on the network.

When a plurality of ink jet printers, e.g., 16 printers, are to be monitored by the host computer 100, the host computer 100 may use the ink consumption data based on the signal Sr only from the conductive wire 88C of each ink tank in deciding whether the ink tank replacement level is reached or not.

Figure 11:
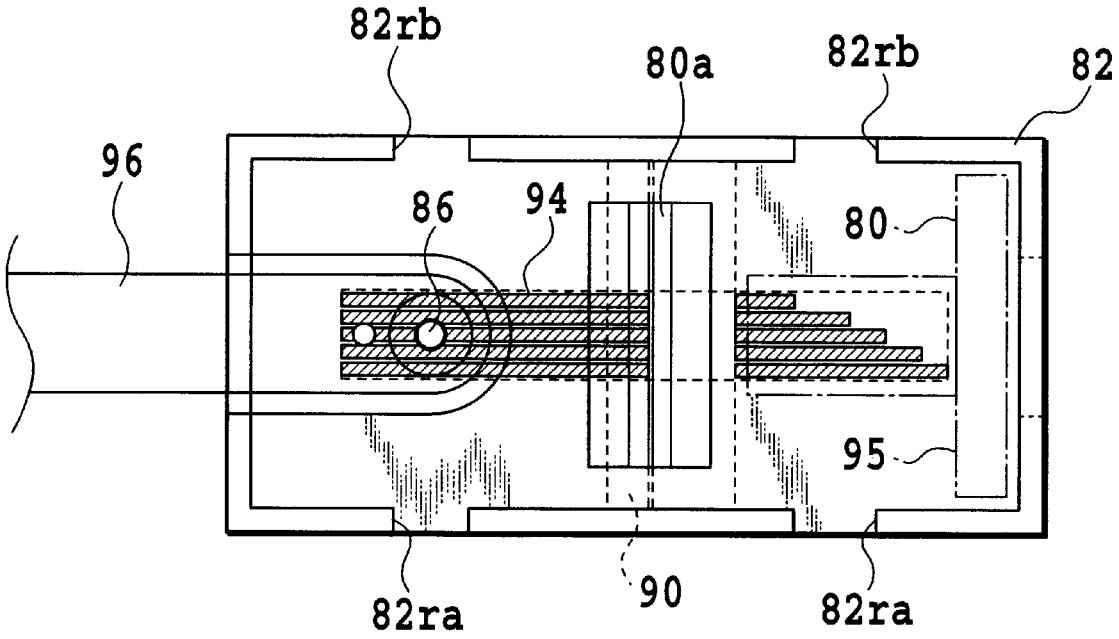
FIG. 11 is a plan view showing an ink consumption detection unit used in another example of the print liquid tank according to the invention.

FIG. 11 shows an essential part of the ink consumption detection unit used in another example of the print liquid tank according to the present invention. In FIG. 11 the constitutional elements identical to those of FIG. 1 are given like reference numerals and their explanations are omitted.

In the example shown in FIG. 1, the contact electrode plate 88 has three branch electrodes and the contact tape 84 has three contact electrodes, whereas in the example shown in FIG. 11 a contact electrode plate 95 has five branch electrodes and a contact tape 94 has five contact electrodes.

Figure 12:
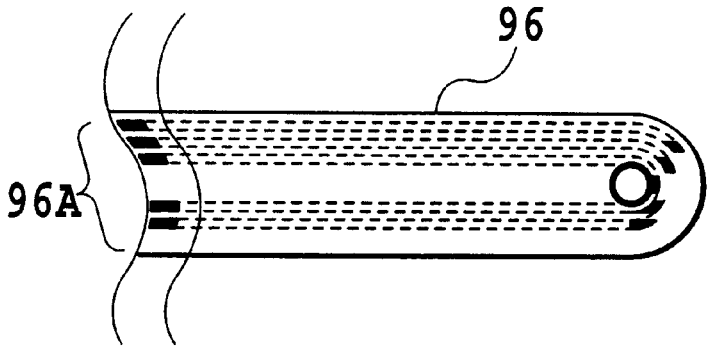
FIG. 12 is a plan view schematically showing an electrode plate used in the example of FIG. 11.

An electrode plate 96 connected to one end of the contact tape 94, as shown in FIG. 12, has conductors 96A formed therein corresponding to the five contact electrodes described later. The portions of the conductors 96A to be connected to the five contact electrodes are exposed.

Figure 13:
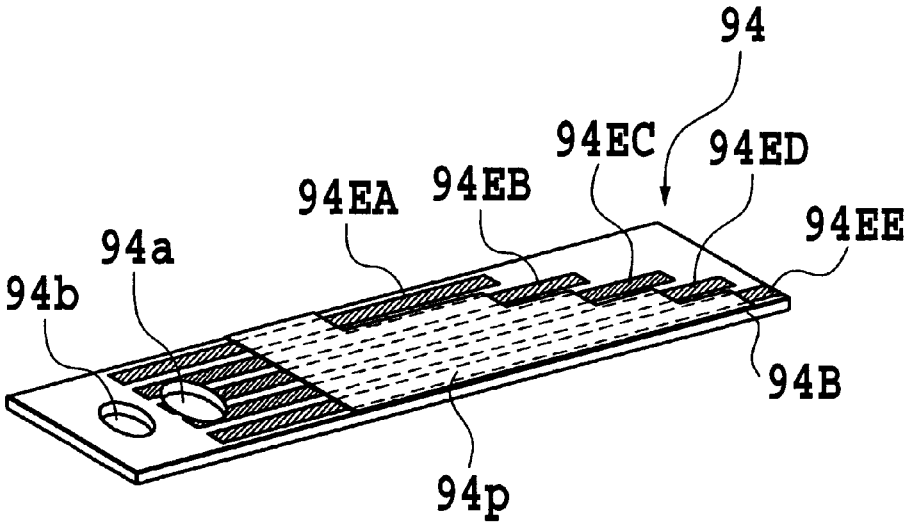
FIG. 13 is a perspective view showing a contact tape used in the example of FIG. 11.
Figure 14A:
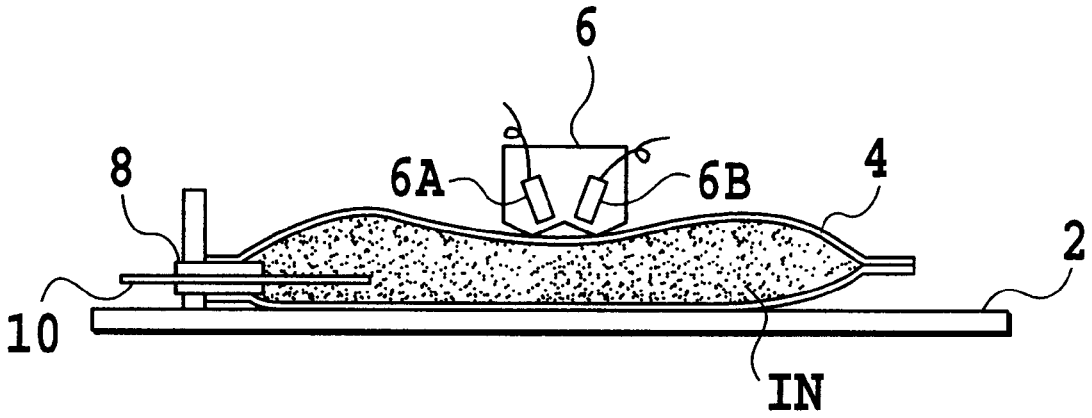
PRIOR ART FIG.14A
FIGS. 14A and 14B are schematic diagrams showing a construction of a conventional apparatus.
Figure 14B:
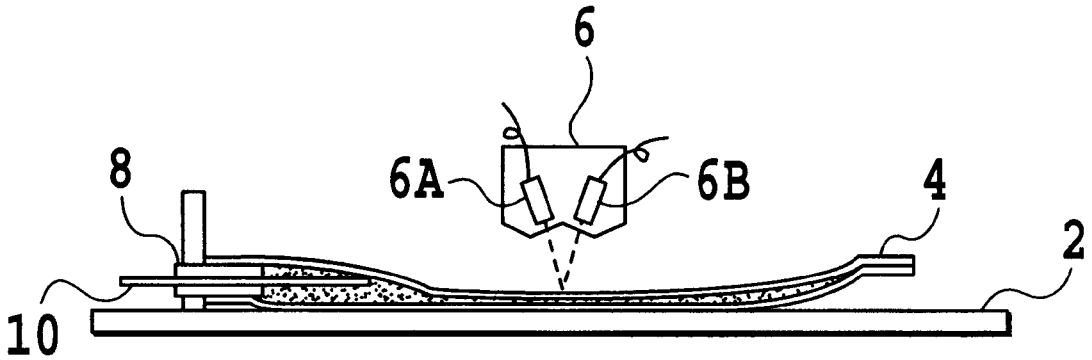
PRIOR ART FIG.14B
Figure 15A:
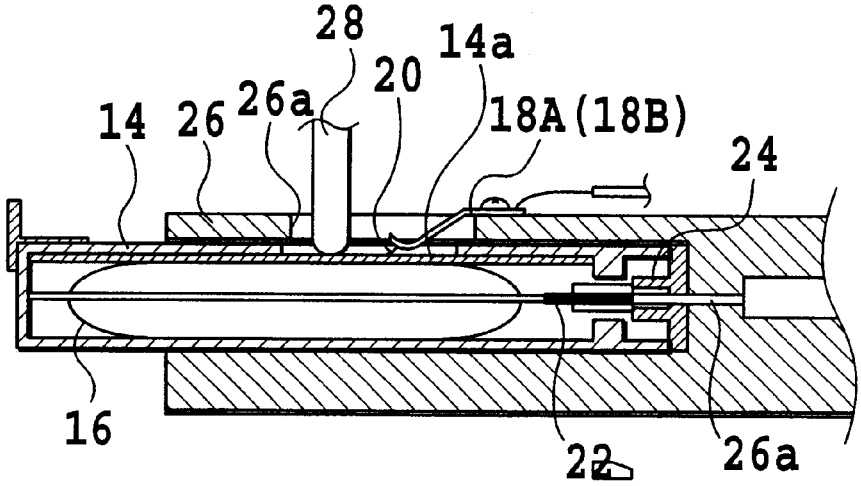
PRIOR ART FIG.15A
FIG. 15A is a cross section showing a construction of a part of the conventional apparatus.
Figure 15B:
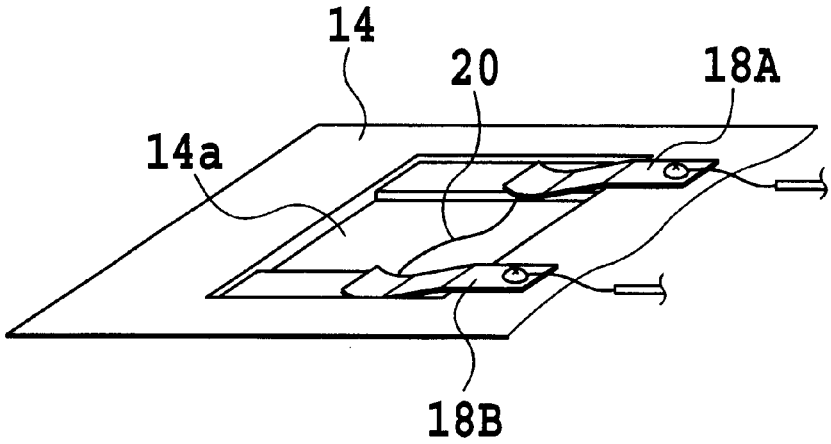
PRIOR ART FIG.15B
FIG. 15B is a perspective view showing an essential part of the example of FIG. 15A.

The contact tape 94, as shown in FIG. 13, has contact electrodes 94EA, 94EB, 94EC, 94ED, 94EE formed by screen-printing an ohmic resistant carbon paste on the surface of a polyester film 94B 0.1 mm thickness. The contact tape 94 has through-holes 94*a*, 94*b* punched out at one end of the contact electrodes 94EA–94EE. The contact electrodes 94EA–94EE with resistances of about 300–1500Ω are formed parallel to one another at predetermined intervals. The contact electrodes 94EA–94EE having different lengths are formed so that their positions at one end are aligned. The contact electrode 94EA is set to be shortest, the contact electrode 94EE longest, and the contact electrodes 94EB, 94EC, 94ED intermediate but progressively increasing in length.

Further, the contact electrodes 94EA–94EE are partly covered with an insulating layer 94P. The insulating layer 94P is formed stepwise corresponding to the contact electrodes 94EA–94EE by using, for example, an insulating paste (ultraviolet curing ink paste). At one end of the insulating layer 94P on the through-hole 94*a* side, the ends of the contact electrodes 94EA–94EE are exposed over the same lengths. The insulating layer 94P has its portion corresponding to the contact electrode 94EA formed shortest, its portion corresponding to the contact electrode 94EE formed longest and its portions corresponding to the contact electrodes 94EB, 94EC, 94ED formed intermediate but progressively increasing in length.

One end of the contact tape 94 is joined, through thermal caulking, to the electrode plate 96 by fitting the through-hole 94*b* over the pin member 86. The other end of the contact tape 94, after passing through the through-hole 80*a* and engaging the guide pin 90, is held by the contact electrode plate 95.

When the ink in the ink bag 68 is not consumed, with the tape holding plate 80 and the contact electrode holding case 82 close to each other, one of the branch electrodes of the contact electrode plate 95 corresponding to the contact electrode 94EA is directly in contact with the contact electrode 94EA and other branch electrodes are in contact with the insulating layer 94P.

Hence, as in the previous example, when the tape holding plate 80 and the contact electrode holding case 82 begin to move away from each other as the ink in the ink bag 68 is consumed, the contact electrode 94EA moves in sliding contact with the associated branch electrode of the contact electrode plate 95 and then. comes out of contact. At the same time, the other contact electrodes 94EB–94EE move from the non-contact state into a direct contact with the associated branch contacts, one after another, according to the distance traveled.

In a further example of the print liquid tank according to the invention, the ink bag, used instead of the ink bag 68 of the above example, is made from a laminated film consisting of an inner layer and an outer layer, the inner layer having an oriented polypropylene film (of TOPPAN PRINTING Co, Ltd. make) 12 μm thickness and a GL-E type film of a polyester film 12 μm thickness formed on its surface with a silica vapor-deposited layer for sealing a gas, the outer layer having an oriented nylon film 16 μm thickness. Other structural aspects of the ink tanks are similar in constitutional elements and method to the previous example. Such ink tanks may have ink bags each filled with 40 ml of ink and fitted with an on-off valve, with its engagement portions sealed with an epoxy bonding agent to prevent ink leakage.

Next, the inventor of this invention conducted experiments, in which an iron plate was placed on the ink bag to apply a pressure of 147.1 Pa (reference value: 1.5 g/cm$^2$) to the bag, at which time the bag was 11 mm thickness. When 30 ml of ink was consumed, the bag was 4 mm thickness; after the consumption of 35 ml, it was 3 mm thickness; after the consumption of 38 ml, it was 0.9 mm thickness; and after the consumption of 40 ml, it was 0.2 mm thickness.

Considering the fact that there can be no significant changes in ink volume under a relatively low pressure (1–10 atmospheres), similar experiments were also conducted under increased loaded pressures to check for any change in the height of the ink bag. At a pressure of 19,612 Pa (reference value: 200 g/cm$^2$), no significant difference in the height of the bag was found.

However, when the loaded pressure is higher than 4,903 Pa (reference value: 50 g/cm$^2$), the deformation of the case becomes large, making the precise detection of ink consumption difficult. The load pressure to be applied therefore should preferably be less than 4,903 Pa. But the use of reinforcement ribs in the case to prevent possible deformations can increase the permissible pressure range.

Further, heat cycle tests on the ink tank of this invention were conducted by the inventor of this invention in a temperature range of between −10° C. and 60° C.

The tests found no problems. The reason for this is that if the ink should expand due to a temperature rise, the ink volume expansion is absorbed by the coil springs 66 being contracted and that the contact tape 84 of the ink consumption detection unit is acted upon by a force in the contraction direction not in the direction of tension.

In light of these findings, it is preferred that the tape holding plate 80 and the contact electrode holding case 82 in the ink consumption detection unit be assembled with a gap of about 1 mm therebetween.

Further, by increasing the number of contact electrodes from three to four or five, the ink consumption can be detected in smaller steps of change. This makes it possible to precisely estimate the rate of ink consumption and the time of ink tank replacement and efficiently arrange the patterns of original to be printed.

As can be seen from the above examples, because the ink tank can be arranged vertically erect, the degree of freedom in the arrangement of the ink tanks in the ink jet printer increases, dramatically enhancing the freedom of design and size reduction of the ink jet printer.

Further, the ink consumption or the amount of remaining ink is output in binary potential levels "L" and "H" (digital output) directly from three or four or more terminals. This arrangement allows these signals to be fed easily to the printer body or external on-line terminals without using a conversion device such as A/D converter.

As a result, the outputting of these signals can be performed for each of four or six or more color ink tanks without incurring so high a cost, facilitating the use of the ink consumption detection mechanism.

Further, the consumption or the remaining amount of each color ink in the ink jet printer can be detected, which in turn makes it possible to predict and alarm when the ink runs out, thus avoiding a problem of degraded printed image.

Further, it is possible to indicate the time for ink tank replacement and the need for preparing a spare ink tank. That is, necessary prearrangements for the operation of the printer can be made. At the same time, these signals can be transmitted online to other places so that the status of the printer can be checked remotely.

Because the signal level "H" is output at a voltage and current level high enough to directly drive a light emitting diode (LED) or the like, no special adjustable resistor or inversion transistor needs to be provided for the signal detection. This facilitates the display or indication of the consumption of ink in the ink tank.

In the above description, the ink tank and the printing apparatus in the field of the ink jet printing have been described, however, an example of the present invention can be applied to supplying tank and supplying system which supplies material including fuels and medication The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A print liquid tank removably provided on a loading portion of an ink-jet printing apparatus, said print liquid tank comprising:

a baggy storage member for storing print liquid, said storage member being made from a flexible material;

a pressing member for pressing against said storage member in a direction in which a volume of said storage member is reduced;

an electrode member having plural electrode portions, said electrode member having one end thereof connected to a part of an outer circumferential portion of said storage member, said outer circumferential portion being a portion that moves in the pressing direction in response to a consumption of said print liquid, said electrode portions having lengths arranged stepwisely along said electrode member; and a contact electrode unit having a plurality of contact portions each constructed for electrical contact with a respective one of said electrode portions of said electrode member wherein as said print liquid is consumed, said electrode portions of said electrode member move relative to said contact portions of said contact electrode unit so that each of said electrode portions is brought into contact or out of contact with each of said contact portions sequentially, thus permitting to detect that said print liquid has been consumed to a predetermined consumption level or above said level.

2. A print liquid tank according to claim 1, wherein said electrode member and said contact electrode unit are arranged between said storage member and a case accommodating said storage member.

3. A print liquid tank according to claim 1, wherein said contact electrode unit issues a detection output in which a signal level of said detection output changes from a low level to a high level corresponding to a change in consumption level from a first level to a second level.

4. A print liquid tank according to claim 3, wherein further comprising a LED portion which varies colors according to change of a signal level of said detection output from a low level to a high level.

5. A print liquid tank according to claim 1, wherein said pressing member presses said storage member with a pressing force of 98.0 Pa or more.

6. A print liquid tank according to claim 1, wherein said contact electrode unit has a voltage source of voltage between or equal to 5 volts and 24 volts with respect to said electrode portion having a predetermined ohmic resistance.

7. A printing apparatus having a print liquid tank, comprising:

said print liquid tank according to claim 1, wherein said print liquid tank further comprises a controllable on-off valve to shut off discharge of said print liquid;

a printing portion supplied with a print liquid from said print liquid tank and ejecting said print liquid to perform a print operation; and a controller to control said on-off valve and to issue an output representing said liquid consumption in said storage member.

8. A printing apparatus having a print liquid tank according to claim 7, wherein said controller issues a digital signal representing said liquid consumption.

9. A printing apparatus having a print liquid tank according to claim 7, further comprising a LED portion for indicating the amount of remaining liquid in said liquid tank on the basis of an output from said controller by changing a color.

10. A print liquid tank according to claim 1, wherein a control valve for controlling a discharging amount of said print liquid is provided in a print liquid supplying portion disposed at said storage member.

11. A print liquid tank according to claim 1, wherein said electrode portions are formed by film members which are terminated at individually different positions.

12. A print liquid tank according to claim 11, wherein said film members are partly covered with an insulating layer, and an area size covered with said insulating layer varies from one film member to another film member.

13. A print liquid tank according to claim 12, wherein among said film members, said area size covered with said insulating layer is smallest for a film member terminated at a shortest distance position, and said area size covered with said insulating layer is largest for a film member terminated at a longest distance portion.

14. An ink tank removably provided on an ink-jet printing apparatus, for storing ink to be supplied to a print head comprising:

a flexible baggy member for storing ink;

a housing for accommodating said baggy member;

a detecting element for detecting displacement of said baggy member in response to consumption of said ink; and LED elements for stepwisely indicating an ink consumption in accordance with the displacement detected by said detecting element.

15. An ink tank according to claim 14, wherein said detecting element comprises:

an electrode member having plural electrode portions, said electrode member having one end thereof connected to an outer circumferential portion of said storage member, said outer circumferential portion being a portion that moves in the pressing direction in response to a consumption of said print liquid, said electrode portions having lengths arranged stepwisely along said electrode member; and a contact electrode unit having a plurality of contact portions each constructed for electrical contact with a respective one of said electrode portions of said electrode member;

wherein as said print liquid is consumed, said electrode portions of said electrode member move relative to said contact portions of said contact electrode unit so that each of said electrode portions is brought into contact or out of contact with each of said contact portions sequentially, thus permitting to detect that said print liquid has been consumed to a predetermined consumption level or above said level.

16. An ink tank according to claim 15, wherein said electrode portions are formed by film members which are terminated at individually different positions;

wherein said film members are partly covered with an insulating layer, and an area size covered with said insulating layer varies from one film member to another film member; and wherein among said film members, said area size covered with said insulating layer is smallest fro a film member terminated at a shortest distance position, and said area size covered with said insulating layer is largest for a film member terminated at a longest distance position.

* * * * *

UNITED STATES PATENT AND TRADEMARK OFFICE

CERTIFICATE OF CORRECTION

PATENT NO. : 6,513,891 B2
DATED : February 4, 2003
INVENTOR(S) : Masataka Eida

It is certified that error appears in the above-identified patent and that said Letters Patent is hereby corrected as shown below:

Column 1,
Line 23, "easily ,received" should read -- easily, received --.

Column 4,
Line 17, "of the a" should read -- of a --; and
Line 21, "consumption this" should read -- consumption. This --.

Column 5,
Line 2, "thicknessr" should read -- thickness --; and
Line 7, "experiments" should read -- experiments --.

Column 8,
Line 46, "ink." should read -- ink --.

Column 10,
Line 7, "an" should read -- a --.

Column 11,
Line 61, "nk" should read -- ink --.

Column 12,
Line 4, "insertinging" should read -- inserting --.

Column 13,
Line 59, "and an" should read -- and a --.

UNITED STATES PATENT AND TRADEMARK OFFICE

CERTIFICATE OF CORRECTION

PATENT NO. : 6,513,891 B2
DATED : February 4, 2003
INVENTOR(S) : Masataka Eida

It is certified that error appears in the above-identified patent and that said Letters Patent is hereby corrected as shown below:

Column 16,
Line 19, "then." should read -- then --.

Column 20,
Line 24, "fro" should read -- for --.

Signed and Sealed this

Second Day of September, 2003

JAMES E. ROGAN
*Director of the United States Patent and Trademark Office*